United States Patent [19]

Ames et al.

[11] 4,208,898

[45] Jun. 24, 1980

[54] PROCESS AND DEVICE FOR EXTRUDING A PLURALITY OF COMPOSITE SECTIONS

[75] Inventors: Adolf Ames, Hilzingen; Alfred Wagner, Steisslingen; Ulrich Zillmann, Mühlhausen, all of Fed. Rep. of Germany

[73] Assignee: Swiss Aluminium, Ltd., Chippis, Switzerland

[21] Appl. No.: 48,181

[22] Filed: Jun. 13, 1979

Related U.S. Application Data

[63] Continuation-in-part of Ser. No. 874,069, Feb. 1, 1978, abandoned.

[51] Int. Cl.[2] ..... B21C 23/24; B21C 23/22; B21C 33/00; B21C 23/01

[52] U.S. Cl. ..... 72/258; 72/256; 72/262; 72/259; 72/261

[58] Field of Search ..... 72/253, 256, 258, 262, 72/268, 269, 270, 261, 259; 425/224, 114

[56] References Cited

U.S. PATENT DOCUMENTS

| | | | |
|---|---|---|---|
| 2,256,545 | 9/1941 | Bothmann | 72/260 |
| 2,624,914 | 1/1953 | Rhodes | 425/113 X |
| 2,782,498 | 2/1957 | Mushovic et al. | 29/149.5 S |
| 3,113,676 | 12/1963 | Harkenrider | 72/262 |
| 3,152,059 | 10/1964 | Wellington | 72/258 |
| 3,276,103 | 10/1966 | Kopke et al. | 29/149.5 S |
| 3,408,727 | 11/1968 | Dion | 228/170 |
| 3,444,610 | 5/1969 | Thompson | 228/170 |
| 3,568,753 | 3/1971 | Clarke | 164/86 |
| 3,702,497 | 11/1972 | Dion | 72/256 |
| 3,911,705 | 10/1975 | Voorhes | 72/270 |
| 3,922,898 | 12/1975 | Voorhes | 72/262 |
| 3,934,446 | 1/1976 | Avitzur | 72/262 |
| 4,041,595 | 8/1977 | Voorhes | 72/262 |
| 4,080,816 | 3/1978 | Ames et al. | 72/261 |

FOREIGN PATENT DOCUMENTS

| | | | |
|---|---|---|---|
| 109001 | 3/1900 | Fed. Rep. of Germany | 72/261 |
| 1255916 | 12/1967 | Fed. Rep. of Germany | 425/113 |
| 2208859 | 8/1973 | Fed. Rep. of Germany | 72/258 |
| 2511301 | 9/1976 | Fed. Rep. of Germany | 72/258 |

*Primary Examiner*—Ervin M. Combs
*Assistant Examiner*—D. M. Gurley
*Attorney, Agent, or Firm*—Bachman and LaPointe

[57] ABSTRACT

A process and device for carrying out the process allows for the extrustion of composite sections comprising a beam-like section made of a light metal and at least one insert made of another metal which provides a facing on at least one surface of the beam-like section. The beam-like section, which may be a conductor rail, is produced by extruding through a shape-giving die whereby at least two composite sections are produced simultaneously and the facing strips are positioned pairwise between opposite lying parts of the beam-like sections. The present invention allows the facing strips to be introduced into the extrusion device without the extreme bending previously experienced. Brittle materials which could not withstand the extreme bending experienced heretofore can now be used for facing material.

16 Claims, 5 Drawing Figures

PROCESS AND DEVICE FOR EXTRUDING A PLURALITY OF COMPOSITE SECTIONS

CROSS REFERENCE TO RELATED APPLICATION

The present application is a Continuation-In-Part of co-pending application Ser. No. 874,069, Filed Feb. 1, 1978, now abandoned.

BACKGROUND OF THE INVENTION

The present invention resides in a process for simultaneously extruding a plurality of composite sections comprising a beam-like section, in particular a beam-like section shaped out of a light metal matrix, and at least one shaped strip insert of another metal which forms at least part of the surface of the beam-like section. The beam-like section of the composite section, which may be used as a conductor rail, is produced by extruding a billet through a shape-giving opening in an extrusion die wherein at least two composite sections are produced simultaneously and the shaped facing strips are positioned pairwise between the opposite lying parts of the beam-like sections to be provided with the facing strip.

The present invention further comprises a device for carrying out the process and includes at least one die having a shape-giving opening.

The prior art, as evidenced by German Pat. No. 25 11 301, deals with a process and a device for carrying out the process wherein unplated metal strips are joined intimately to a metal matrix while avoiding friction between the metal strips and the extrusion die and at the same time permitting economic production of various shapes of composite section for a wide range of applications.

SUMMARY OF THE INVENTION

The present invention improves on the basic concept of German Pat. No. 25 11 301 and comprises the laying of two facing strips one on top of the other and extruding these along with the matrix and separating the two, simultaneously produced composite sections at the interface between the two facing strips, whereby the improvement is achieved by leading the matrix for the rail-like section continuously over moving surfaces on both sides of the facing strips which usefully pass through the shape-giving opening in the die.

In accordance with another feature of the present invention continuously moving surfaces are provided at the sides of the die opening and the facing strips led between these and at a distance from them. The moving surfaces should usefully be parts of wheels flanking the die opening, the said wheels forming, at least in front of the die, a channel around the facing strips which are at the central axis of the said channel which serves to feed the matrix material approximately tangentially to the wheels.

The facing strips then no longer pass through the guide slits in the die ahead of the die opening, but instead are led without undue force to the die and, as a result of the wheels in front of the die opening conveying the matrix material to the die, are surrounded by this material. The said matrix material is conveyed on both sides of the pair of facing strips in two streams or strands which are brought to lie on each of the facing strips in a sandwich-like manner in front of the die.

In the preferred embodiment at least one groove is provided in the circumferential face of each wheel, and the walls of the grooves in the wheels which are approximately radially in line on either side of the die form the channel surrounding the strips and at a distance from them and this in front of the shaping tool.

In accordance with the present invention the die is provided, in the gap formed by the wheels and this at a distance from a guiding mandrel, with at least one opening for the facing strips either parallel to or coaxial with the shape-giving opening in the die; the guiding mandrel brings the facing strips to form a straight strand at the die opening and, with its outer faces shaped to correspond to the curvature of the neighboring wheels, forms guiding channels for the streams of matrix material.

Sliding rollers are provided on the outer faces of the guide mandrel and/or in its bore in order to facilitate easier introduction of the matrix and facing sections into the extrusion device.

The device of the present invention permits the facing sections to be introduced straight so that the previous bending of the facing strips up to the die opening is now eliminated. The linear feed of the facing strip allows this strip to be made of relatively brittle material which cannot be bent to a small radius.

It is also within the scope of the present invention to extrude more than two composite sections simultaneously. For this, at least one so-called intermediate support strip is provided between the composite sections the facing strips of which lie next to the outer faces of the said intermediate strip. Such intermediate strips also allow facing sections which are concave or convex in cross section to be extruded; the intermediate strip concerned also has for this purpose curved outer faces (as viewed in cross section) which support the facing sections.

Such intermediate strips can be removed from the strand emerging from the shaping tool or die and can be used again. The facing strips can be advanced by making them pass through a drive mechanism which is separate from the rollers. In accordance with another feature of the invention the facing strips can be advanced by means of at least one of the rollers being power driven.

BRIEF DESCRIPTION OF THE DRAWINGS

Further advantages, features and details of the present invention will appear from the following description of exemplified embodiments with the aid of the drawings, where.

DETAILED DESCRIPTION

Figures 1, 2, 3:
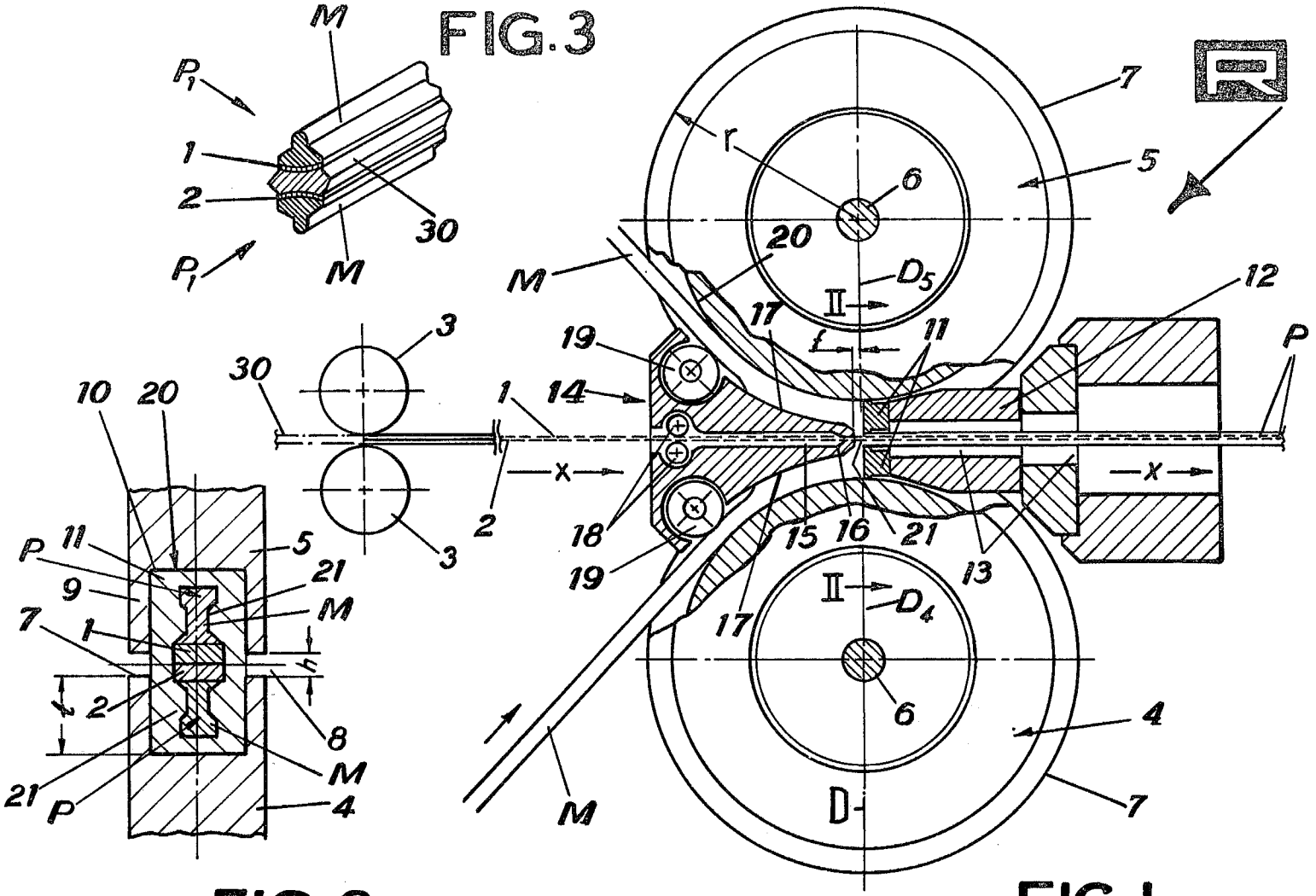
FIG. 1 is a longitudinal cross section through a device for extruding composite sections in accordance with the invention.
FIG. 2 is a cross section through part of FIG. 1 along the line II—II.
FIG. 3 is a perspective view of sectioned composite extrusions with an intermediate support strip provided between them.

Two steel facing strips 1, 2 are, as shown in FIG. 1, uncoiled from two reels, indicated by 3 in the figure, and guided in the direction of the arrow x to an extrusion device R for the continuous production of the composite sections P.

The extrusion device R has two profiled wheels 4, 5 with an outer radius r of 0.5 m for example, and which can rotate about the axes 6. The diameters $D_4$, $D_5$ of the two profiled wheels 4, 5 are perpendicular to the steel facing strips 1, 2 which move on an approximate horizontal plane, and the said diameters $D_4$, $D_5$ lie on a common straight line D so that the peripheral faces 7 combine to form a gap 8 of height h (FIG. 2).

A groove 10 of depth t and with sides 9 is provided in the peripheral face 7 of each of the wheels 4, 5; the space created by the two grooves 10 of the wheels, 4, 5 at that line D is filled by a die 11 which is secured on a die slide 12 with the channel 13 through which the strips 1, 2 pass.

On the side of the line D opposite that of the die 11 there is a mandrel 14, which is approximately triangular in shape as viewed in longitudinal section, and which has an entry channel 15 with a taper 16 at a short distance f from the die 11 and along which the strips 1, 2 pass. This mandrel 14 is provided with rollers 18 on both sides of the inner channel 15 and with rollers 19 on the outer walls 17 which are curved to the same shape as the peripheral face 7 of the wheels 4, 5. The small rollers 18 in the inner channel 15 lead the strips 1, 2 between them, while the larger rollers 19 engage a strand M of matrix fed tangentially to each of the wheels 4, 5 and hold it against the base 20 of the groove 10; both strands M of matrix material are led from the wheels 4, 5 to the die 11 and pressed through its opening 21; as a result the matrix M bonds itself to the outer faces of the strips 1, 2, which lie one on top of the other and move together, to form two separate composite sections P.

In order to extrude composite sections P, with curved, arc-shaped surfaces as shown in FIG. 3, an intermediate strip 30, which is concave on both sides and, as indicated by broken lines in the left hand side of FIG. 1, is introduced along with the steel strips 1, 2. This intermediate strip 30 separates from the composite sections $P_1$ when they leave the channel 13 in the extrusion device R and is returned again to the entry end of the device R.

Figure 4:
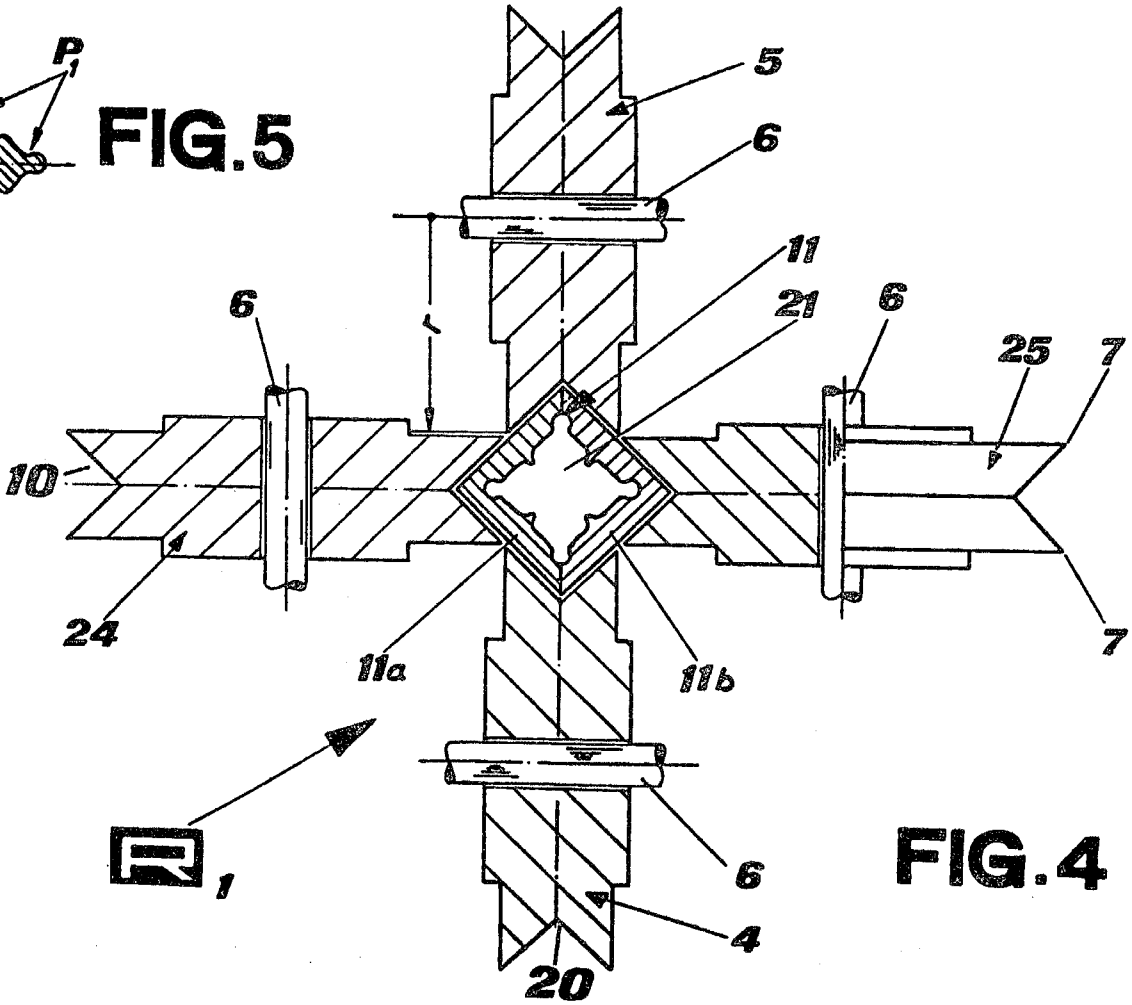
FIG. 4 is a view of part of another exemplified embodiment of the device, approximately along the line represented by D in FIG. 1 and shown partly in cross section.
Figure 5:
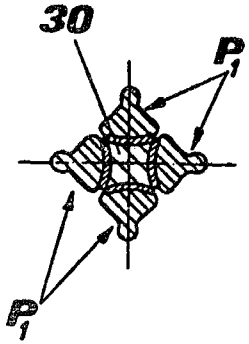
FIG. 5 is a cross section through the composite section which was produced on the device shown in FIG. 4 and which has a releasable support strip.

Four composite sections $P_1$ can be produced simultaneously on the intermediate strip (FIG. 5) by means of the device $R_1$ which is shown in FIG. 4 and which has wheels 4, 5; 24, 25 arranged in the form of a cross around a clover-shaped die opening 21 of a die 11 made up of two die halves 11*a* and 11*b*. The intermediate strip 30 which is led through the axis of the die opening 21 is omitted in FIG. 4 to allow other details to be seen.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A process for the continuous extrusion of a plurality of composite metal sections, each composite metal section comprising a beam-like metal section and at least one insert of shaped strip of another metal which forms at least part of the surface of the beam-like section, the beam-like section of said composite is produced by extruding a billet through a shape-giving opening in an extrusion die, wherein at least two composite metal sections are produced simultaneously, and the shaped strips are fed pairwise between opposite lying parts of opposing beam-like metal sections to be provided with said strip, wherein a plurality of billets for producing said beam-like metal sections are fed continuously on both sides of the strips to the extrusion die on moving surfaces.

2. A process according to claim 1 in which the strips are fed in facing relationship without rubbing friction up to said shape-giving opening at the front of the extrusion die.

3. A process according to claim 1 in which at least one intermediate support strip with concave or convex surface is introduced between facing strips.

4. A process according to claim 1 in which more than two composite sections are extruded simultaneously with facing strips.

5. A process according to claim 1 wherein said beam-like metal section is made of a light metal.

6. A process according to claim 1 wherein said beam-like section is a conductor rail.

7. A process according to claim 1 wherein four composite sections are extruded simultaneously with facing strips and at least one intermediate support strip is introduced between said facing strips.

8. A device for the simutaneous continuous extrusion of a plurality of composite metal sections, each composite metal section comprising a beam-like metal section and an insert of shaped facing strip of another material, which comprises at least one die and die opening for extruding a plurality of billets into a plurality of beam-like metal sections, a plurality of continuously moving surfaces provided at the sides of said die opening for continuously moving said plurality of billets towards said die opening and channel means for guiding said facing strips to said die between opposite lying parts of said beam-like sections wherein the facing strips are arranged such that they can be conveyed along an axial plane by a drive mechanism positioned away from the moving surfaces.

9. A device according to claim 8 in which the moving surfaces are parts of wheels which flank the die opening and which at least in front of the die form an axial channel around the facing strips to which said plurality of billets are led at a tangent to the wheels.

10. A device according to claim 9 in which at least one of the wheels is power driven.

11. A device according to claim 9 in which said wheels are approximately radially placed and at least one groove is provided in a circumferential face of each wheel, and the walls of said grooves on said wheels produce a channel around the facing strips and at a distance from them.

12. A device according to claim 9 in which the die is provided at a gap formed by the wheels, and at a distance from the said die there is provided a guide mandrel which has at least one channel which is parallel or coaxial with the die opening to guide at least said facing strips to said die opening.

13. A device according to claim 12 in which the guiding mandrel projects between the wheels and the outer surfaces of the guiding mandrel projecting between the wheels forms, together with the outer faces of the wheels or their grooves, channels for introducing said plurality of billets into the device.

14. A device according to claim 13 in which rollers are provided on the outer faces of the guiding mandrel and/or in its channel and are for easy movement of the billets and/or the facing strips.

15. A device according to claim 8 in which at least one intermediate support strip is provided between the facing strips.

16. A device according to claim 15 in which the surface of the support strip is concave or convex.

* * * * *

UNITED STATES PATENT AND TRADEMARK OFFICE

CERTIFICATE OF CORRECTION

PATENT NO. : 4,208,898

DATED : June 24, 1980

INVENTOR(S) : Adolf Ames, Alfred Wagner & Ulrich Zillman

It is certified that error appears in the above-identified patent and that said Letters Patent are hereby corrected as shown below:

Column 4, line 32, claim 8, after "the" delete "simutaneous".

Signed and Sealed this

*Nineteenth* Day of *August 1980*

[SEAL]

*Attest:*

SIDNEY A. DIAMOND

*Attesting Officer*

*Commissioner of Patents and Trademarks*